US008118077B2

(12) United States Patent
Pflieger

(10) Patent No.: US 8,118,077 B2
(45) Date of Patent: Feb. 21, 2012

(54) RETRACTABLE ARCHED WINDOW COVERING

(75) Inventor: David C. Pflieger, Two Rivers, WI (US)

(73) Assignees: John E. Nordstrom, Egg Harbor, WI (US); Barbara A. Nordstrom, Egg Harbor, WI (US)

( * ) Notice: Subject to any disclaimer, the term of this patent is extended or adjusted under 35 U.S.C. 154(b) by 3 days.

(21) Appl. No.: 12/363,063

(22) Filed: Jan. 30, 2009

(65) Prior Publication Data

US 2010/0193142 A1 Aug. 5, 2010

(51) Int. Cl.
*E06B 3/94* (2006.01)

(52) U.S. Cl. ..... 160/84.07; 160/134

(58) Field of Classification Search ..... 160/84.07, 160/84.06, 134
See application file for complete search history.

(56) References Cited

U.S. PATENT DOCUMENTS

| | | | | |
|---|---|---|---|---|
| 6,877,546 | B1 * | 4/2005 | Garcia | 160/134 |
| 7,188,658 | B1 * | 3/2007 | Nordstrom et al. | 160/84.07 |
| 7,650,922 | B2 * | 1/2010 | Alberti | 160/84.07 |
| 7,721,782 | B2 * | 5/2010 | Foley et al. | 160/134 |
| 2008/0093031 | A1 * | 4/2008 | Alberti | 160/84.07 |
| 2008/0093032 | A1 * | 4/2008 | Foley et al. | 160/84.07 |
| 2008/0135188 | A1 * | 6/2008 | DeBauche | 160/84.06 |
| 2010/0193142 | A1 * | 8/2010 | Pflieger | 160/84.07 |

* cited by examiner

*Primary Examiner* — Blair M. Johnson
(74) *Attorney, Agent, or Firm* — Alan R. Stewart; Nicholas A. Kees; Godfrey & Kahn, S.C.

(57) ABSTRACT

A shade for an arched window including an arched track with a movable slide base and a pleated blind attached to the slide base. A cord actuates the slide base to move along the track and pull the blind between retracted and extended positions. A top rail of the blind is removably connected to the slide base by a connector and one or more pleats of the blind include connectors which are received within a groove along an inner wall of the track.

15 Claims, 18 Drawing Sheets

104
176
184
186
178

184
188
182
172
104
170
174

104
176
172
170
180
174
178

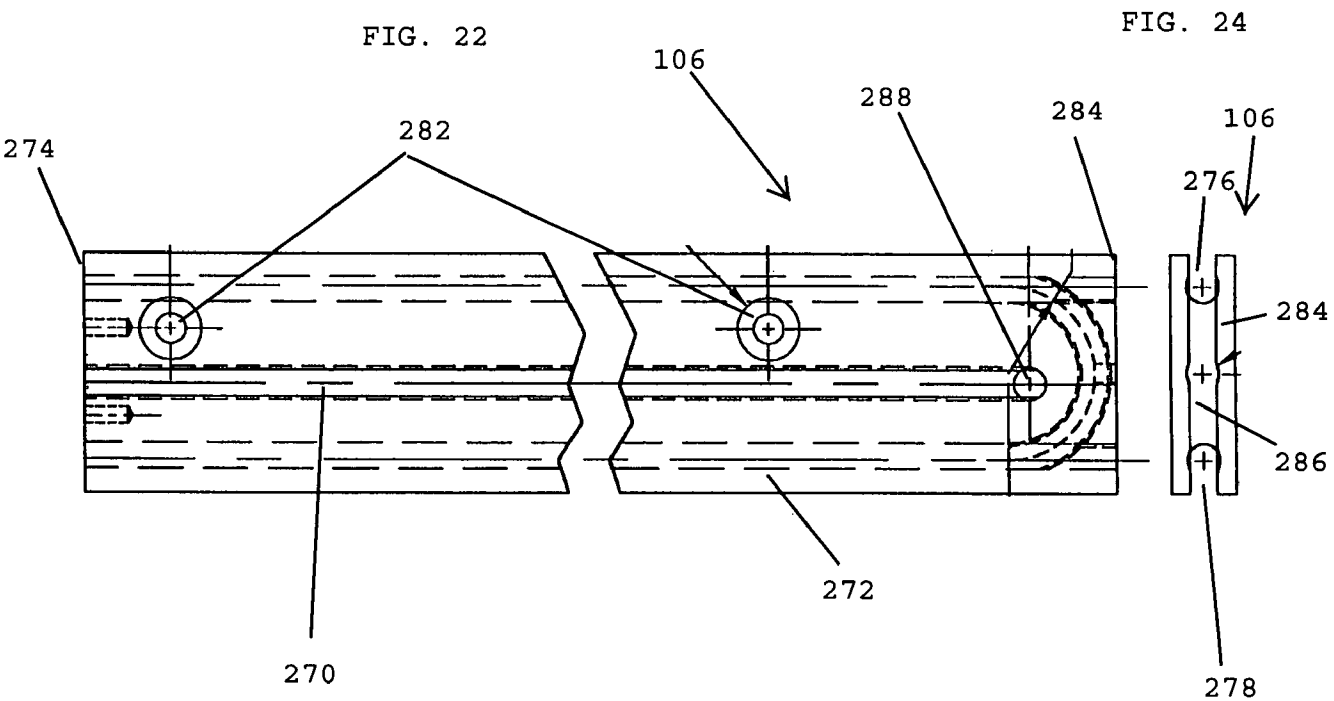
FIG. 24
FIG. 22
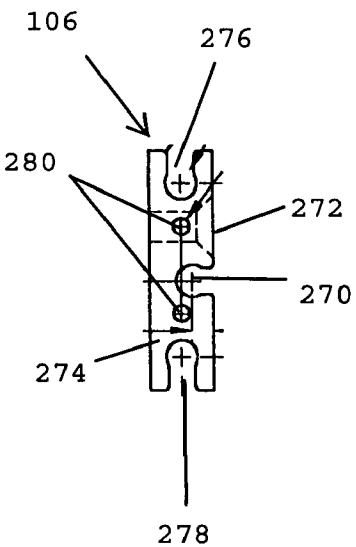
FIG. 23

FIG. 34
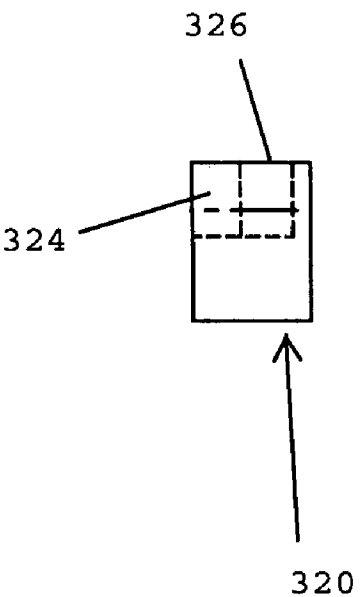
FIG. 33
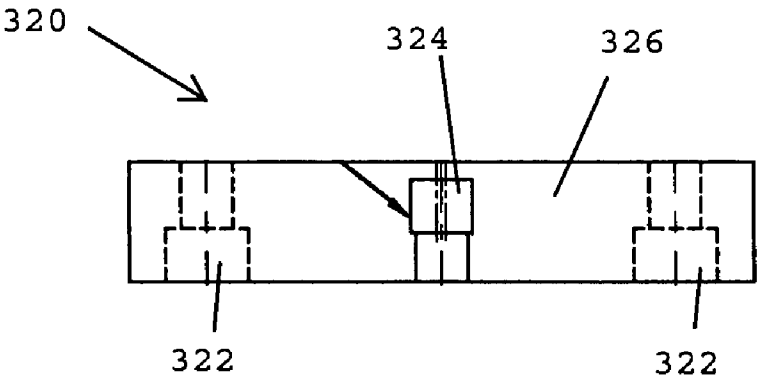
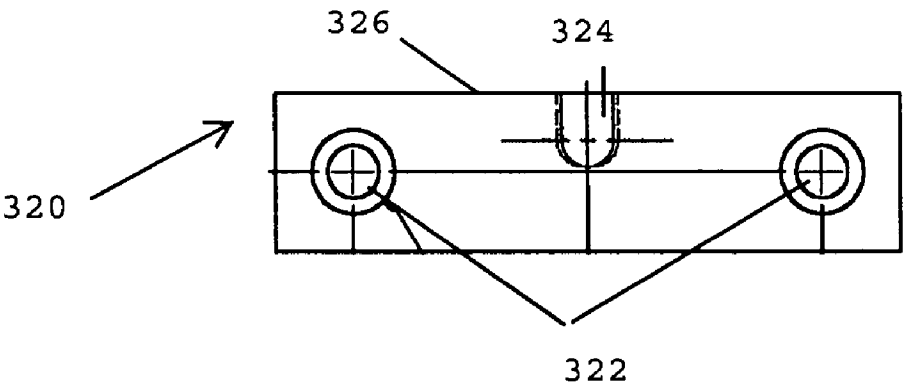
FIG. 32

RETRACTABLE ARCHED WINDOW COVERING

CROSS-REFERENCE TO RELATED APPLICATION

The present application claims priority to commonly-owned and co-pending U.S. patent application Ser. No. 11/558,631, the disclosure of which is incorporated herein by reference.

BACKGROUND

The present invention relates generally to apparatus for mounting blinds within arched windows and drawing the blind across the window to block some or all of the visibility through the arched window. More specifically, the present invention relates to a shade for an arched window including an arched track with a movable carriage and a shade member attached to the carriage.

Many new buildings and homes are designed with arched windows or Palladian style windows and doors. Today, there are several types of coverings available for arched windows, but many tend to be either permanently fixed, that is, not retractable, or they are manually opened and closed. While several retractable style arched window covers are currently commercially available, these designs lack aesthetic appeal, which can severely diminish their value as a decorative item, or they are too cumbersome to use, especially for larger diameter arched windows. Due to design limitations, retractable window coverings are not available for arched windows having relatively large diameters. In addition, the mechanisms may be relatively complex or unattractive.

Consequently, there remains a need for a retractable shade assembly having a cover that can be remotely operated in order to open or close the cover. Preferably, the covering hides the unattractive mechanical elements of the invention that are in plain view to give it an aesthetically pleasing appearance. The covering may be capable of diffusing or blocking sunlight while the covering is in the closed position. Furthermore, the covering preferably accomplishes these goals using a relatively simple mechanical assembly, and with shade members that are readily available with little or no modification.

Conventional approaches exist for using cellular or pleated blinds designed for use with rectangular windows to provide a window covering for arched windows. There are some issues with simply fixing such a blind in an arched window and drawing one corner of the blind around the outer arch of the window. Blinds may tear or distort and improvements to the manner in which a rectangular cellular blind is mounted within an arched window are desirable.

Improvements to conventional approaches to providing arched window shades are desirable.

SUMMARY

The invention provides a retractable window covering for covering an arched window. The window covering may include an arched track having an interior groove along a front facing away from the window and an exterior groove along a rear facing the window. A continuous movable member may extend within the grooves of the front and rear of the track. A carriage may be slidably mounted to the interior groove engaging the movable member within the groove. The carriage may be movable along the track between a first end and a second end. A shade member may have an upper rail and a lower rail with a shade extending therebetween. The outer end of the upper rail may be removably attached to the carriage. Intermediate pleats between the upper rail and the lower rail may include members which are received within a groove formed in an inner face of the arched track.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows:

FIG. 22 is a view of an inner wall of a track according to the present disclosure for use with the system of FIG. 1 and the bead guide of FIG. 17.

FIG. 23 is a first end view of the track of FIG. 22.

FIG. 24 is a second end view of the track of FIG. 22.

FIG. 32 is a front view of a second embodiment of a fabric arm according to the present disclosure for use with the system of FIG. 1 and for mounting to the slide base of FIG. 13.

FIG. 33 is a top view of the fabric arm of FIG. 32.

FIG. 34 is an end view of the fabric arm of FIG. 32.

DETAILED DESCRIPTION

Reference will now be made in detail to exemplary aspects of the present invention which are illustrated in the accompanying drawings. Wherever possible, the same reference numbers will be used throughout the drawings to refer to the same or like parts. References to "cellular" blinds may be taken to include generally pleated shade material as well, assuming the properties of the material are similar.

Specific reference is made to co-pending and commonly owned U.S. patent application Ser. No. 11/558,631, filed on Nov. 10, 2006, the disclosure of which is incorporated herein by reference in its entirety.

Figure 1:
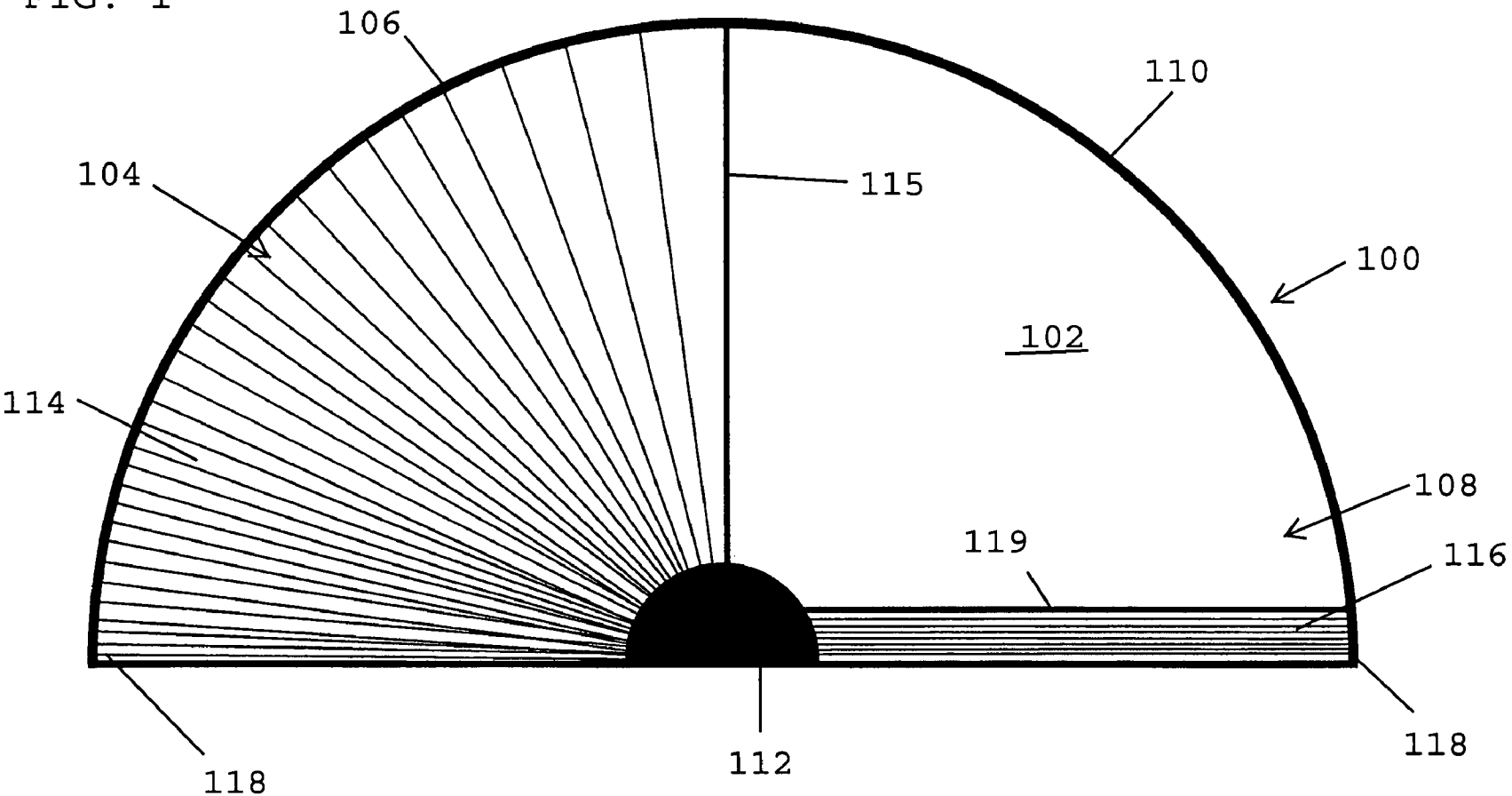
FIG. 1 is a front view of a window shade system for an arched window according to the present disclosure, with two independently actuated shade elements.

FIG. 1 illustrates a window shade system 100 mounted in position adjacent an arched window 102. On a first side 104 of system 100 is a first curved or arched track 106. On a second side 108 of system 100 is a second curved or arched track 110. It is preferable that tracks 106 and 110 generally match the contour of the arched portion of window 102 but other configurations are anticipated within the scope of the present disclosure. Located along a lower edge of system 100 and window 102 may be a central hub 112 within which inboard ends of the blinds within sides 104 and 108 are positioned. Within first side 104 is a first blind 114 is shown in a fully extended position with an upper rail 115 positioned generally vertically and positioned to engage an upper rail of the blind of second side 108.

Within second side 108, a blind 116 is shown in a fully retracted position with an upper rail 119 positioned generally horizontally to provide maximum light entry through window 102. With the system of the present disclosure, the blinds of each side may be positioned independently in any orientation between the fully retracted and the fully extended positions shown. System 100 is shown adjacent arched window 102 which extends for approximately one hundred and eighty degrees with each blind configured to cover approximately one half of the window. It is anticipated that systems with more or fewer blinds may be constructed according to the present disclosure. It is further anticipated that the present disclosure also covers systems for covering windows of less or more than one hundred and eighty degrees of arch.

Figure 2:
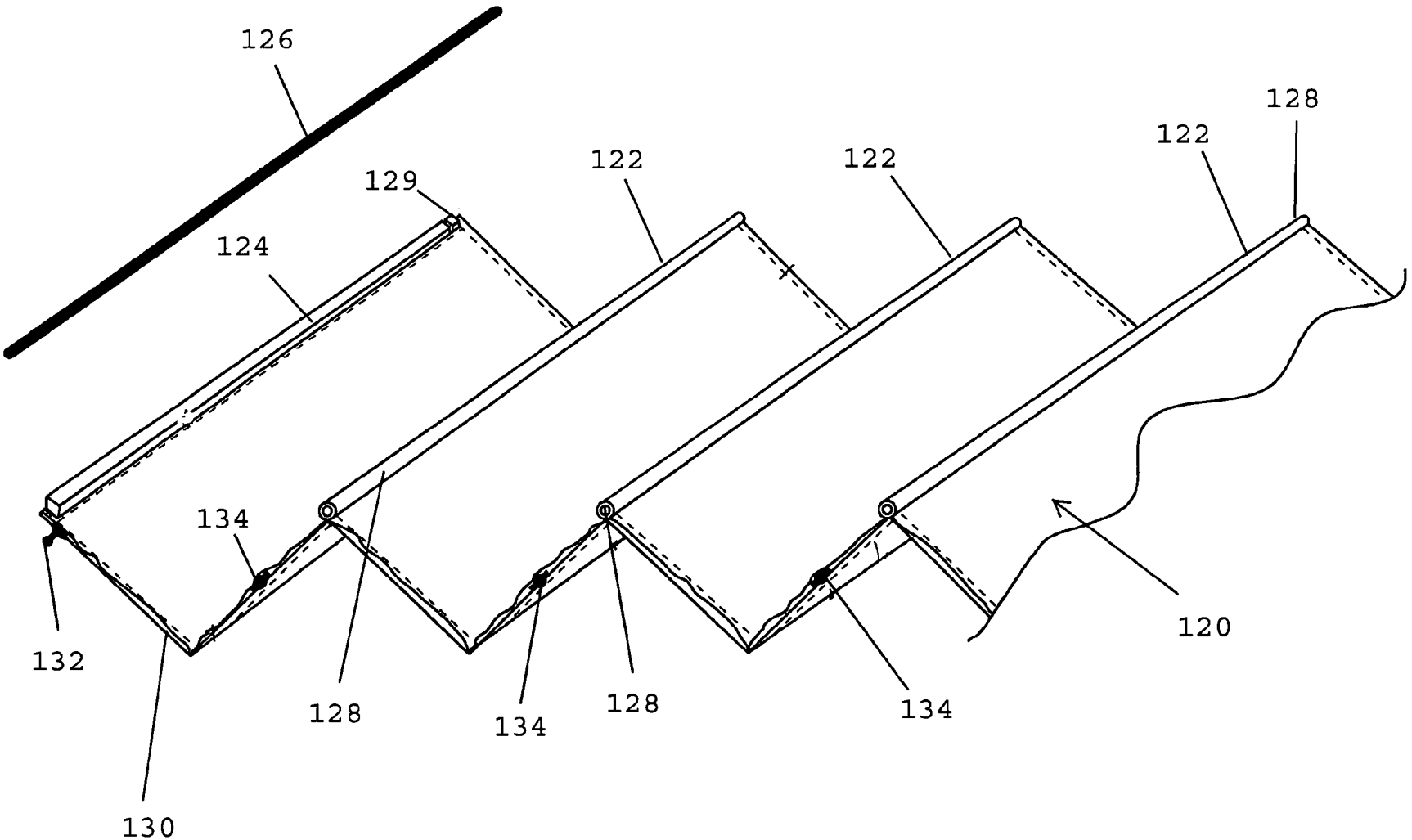
FIG. 2 is a perspective view of a blind according to the present disclosure for use in the system of FIG. 1.

Referring now to FIG. 2, a blind 120 according to the present disclosure includes a plurality of pleats 122 ending with a top rail 124. Top rail 124 may include an internal or external stiffener such as but not limited to wood dowel 126 to maintain the linear configuration of the blind. The stiffener may be sewn entirely within the fabric and thus not visible to viewers on either side of the blind. Alternatively, the stiffener may be mounted to one side or the other if it is desirable to have the stiffener not be visible from only one side. In addition to, or in place of the stiffener, a magnet 129 may be included in the top rail to encourage the two blinds of, for example, system 100 shown above, to mate closely with each other when fully extended. So mated, the blinds would block a maximum amount of light or visibility through window 100.

System 100 may include actuating members such as a bead cord, chain, string, cord or other similar member to allow a user of the system to move the blinds between the extended and retracted positions. In the present disclosure, it is preferable that such a member of system 100 would be actuated by a user with members that extend from the outer lower corners 118 of the system, extending adjacent the lower termination of tracks 106 and 110.

As shown in FIG. 2, blind 120 is a single pleated blind, as opposed to a cellular blind. While cellular blinds are within the scope of the present disclosure, cellular blinds do provide some inherent structural rigidity as they are extended. Single pleated blinds, however, do not have such inherent structural rigidity. While a single pleated blind may be comprised of multiple fabrics, these fabrics are essentially or functionally bonded directly and continuously to each other. Thus, it may be desirable to provide a pocket 128 formed at the top of each pleat, generally on the same side of the blind as the wood stiffener and/or magnet described above.

These pockets 128 may provide some structural rigidity by themselves, and may be sufficient for smaller, thinner or lighter blinds. When the size of the blinds or the nature of the fabric from which the blinds are made dictates, additional intermediate structural support may be provided for the blind in the form of dowels, rods, battens, etc., inserted within one or more of the pockets 128.

Installed as part of blind 120 along an outer edge 130 may be a plurality of connectors to ensure that the blind engages and moves along track 104 or track 108 of system 100. A primary connector 132 may be located as part of the end pleat adjacent top rail 124. Additional connectors 134 may be positioned along edge 130 between adjacent pleats. As will be discussed below, track 106 and 110 may include features to engage connectors 134 to provide support and stiffening tension to blinds 120 as they are extended or retracted along the tracks of system 100. Connector 132 is provided to engage a movable carriage that transits along track 106 and 110 to be actuated by a user of system 100 to change the position of the blinds.

As shown, the connectors 132 and 134 may be the same size, type and style of connector to promote operational and manufacturing efficiency. However, this feature of the present disclosure is certainly not required and it is anticipated that connectors 132 and 134 may be of different sizes and configurations as needed to move and support blind 120 as it is moved along the tracks of system 100.

Figure 4:
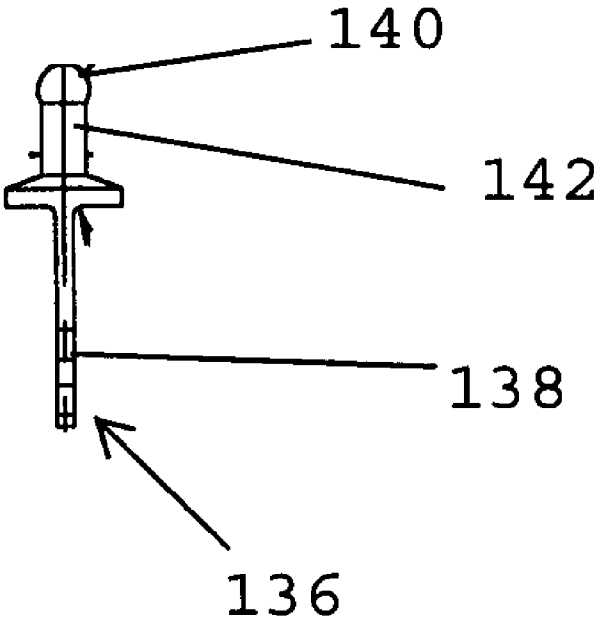
FIG. 4 is a side view of the connector of FIG. 3.
Figure 3:
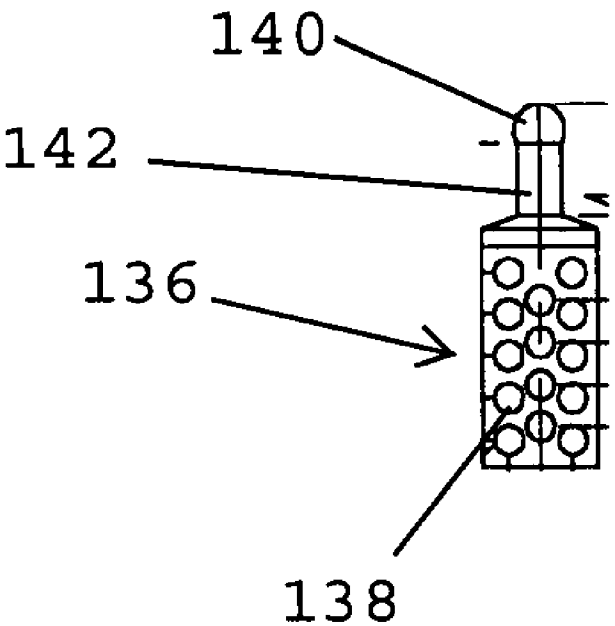
FIG. 3 is a front view of a blind connector according to the present disclosure for use in the system of FIG. 1.
Figure 6:
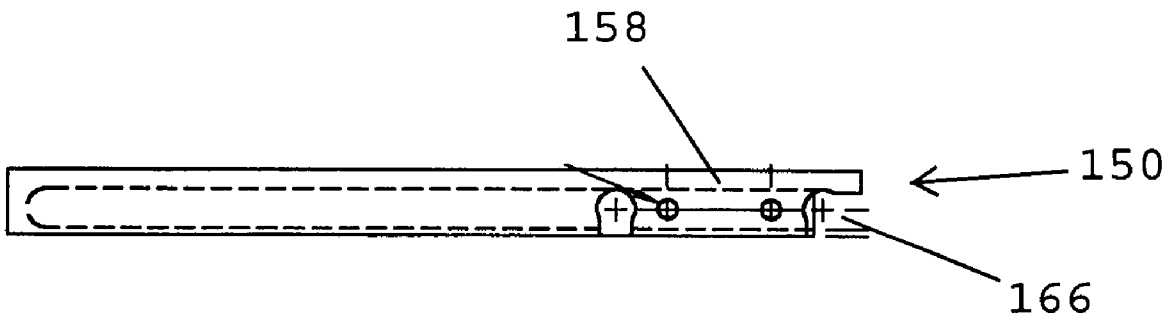
FIG. 6 is a top view of the bead guide portion of FIG. 5.
Figure 5:
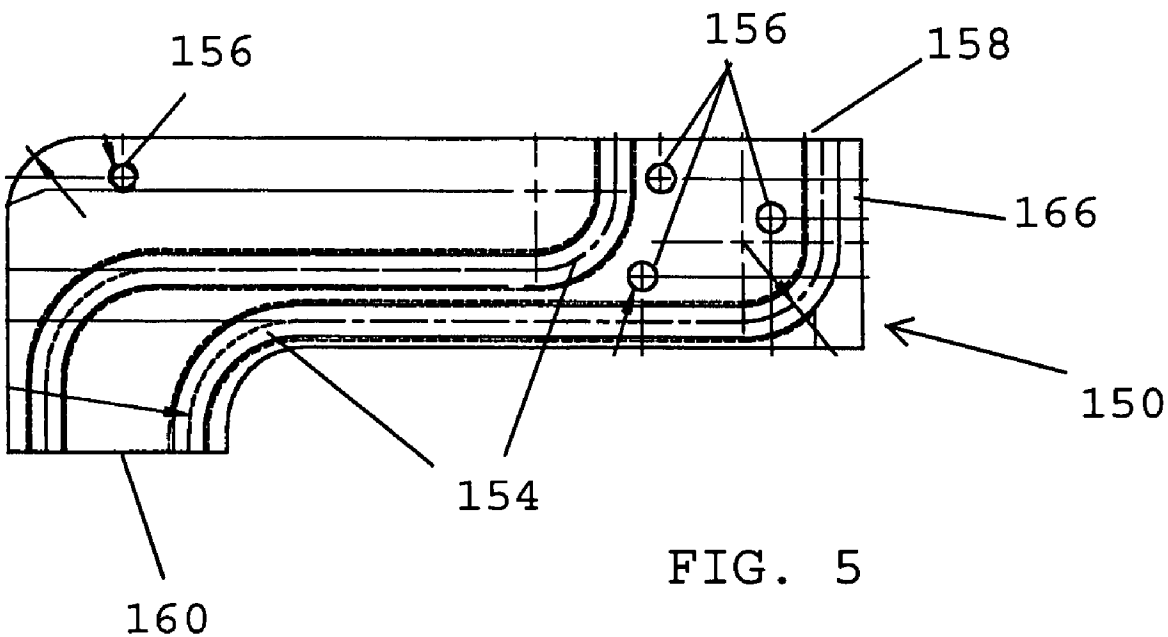
FIG. 5 is an inner wall view of a portion of a bead chain guide according to the present disclosure for use on a first side of the system of FIG. 1.
Figure 7:
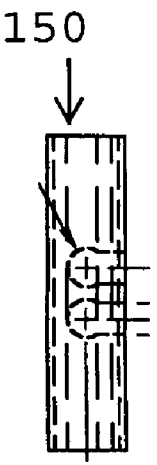
FIG. 7 is an end view of the bead chain guide portion of FIG. 5.
Figure 9:
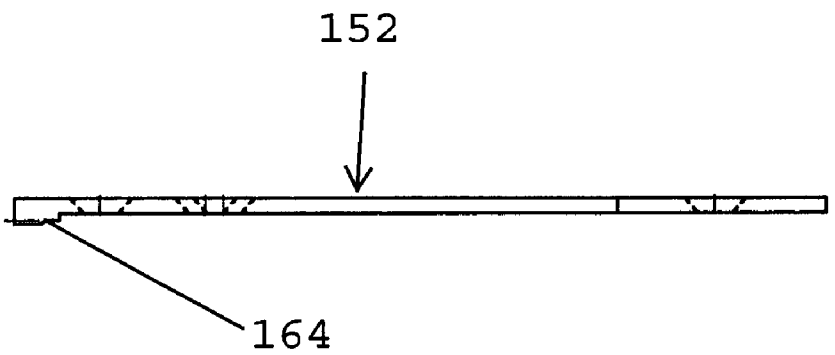
FIG. 9 is a top view of the bead guide portion of FIG. 8.
Figure 8:
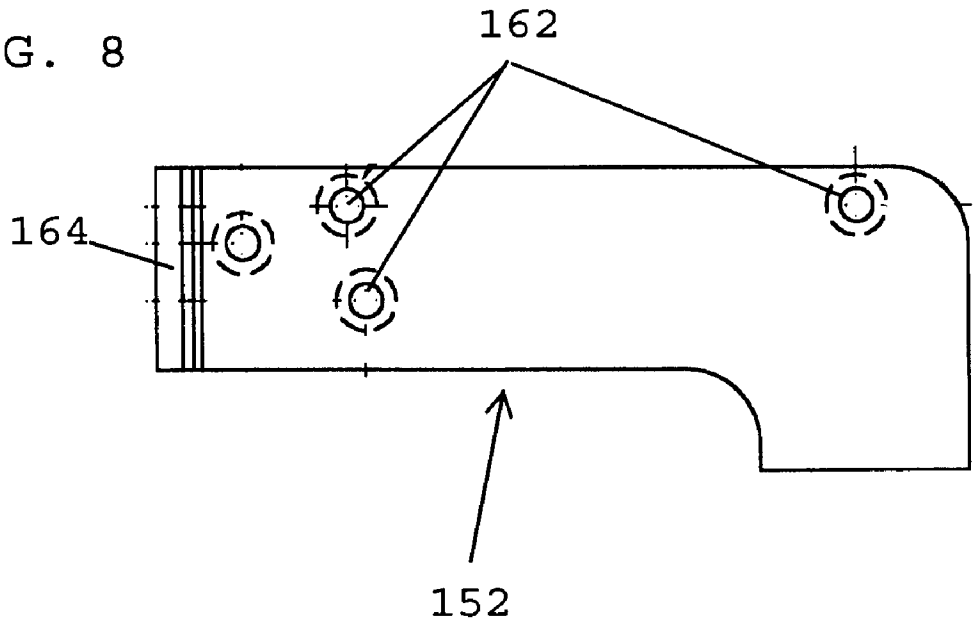
FIG. 8 is an inner wall view of a second mating portion of a bead chain guide according to the present disclosure for use with the system of FIG. 1, in conjunction with the bead guide portion of FIG. 5.

FIGS. 3 and 4 illustrate a bottle connector 136 that may be attached along outer edge 130 to serve as either a connector 132 or 134. Connector 136 includes a tab portion 138 which may be adapted for easy attachment to blind 120. Tab 138 may be sandwiched between fabric layers if blind 120 includes different interior and exterior fabrics for visual impact and sun blocking, respectively. Opposite tab 138 is a ball or bottle connector head 140. Extending between tab 138 and ball 140 is a shaft 142 that is smaller is size than the diameter of ball 140. It is not intended to limit the configuration of connector 132 or 134 to the exact configuration of connector 136. Other connector arrangements and configurations may be used within the scope of the present disclosure.

FIGS. 5 to 9 illustrate first portion 150 and second mating portion 152 of a bead chain guide according to the present disclosure. These portions combine to form an enclosed path for a bead chain to extend into and away from lower ends 118 of track 104. Formed within portion 150 are a pair of grooves 154 through the bead chain may run. Portion 150 also includes a plurality of mounting openings 156 to permit the fastening of the bead guide to the track as well as the fastening of portion 152 to portion 150.

A mounting face 158 is provided for mounting the bead guide to the track with exits from the grooves 154 aligned with grooves in the track through the bead guide runs. At an opposite end 160, grooves 154 direct the bead guide down to be accessed by a user to actuate the blinds. The horizontal distance between the exits at face 158 and the exits at end 160 may be selected and matched to a desired amount offset to permit the bead chain to project out beyond obstructions along the wall to which system 100 is mounted.

Portion 152 is provided to permit the bead chain to be easily routed through grooves 154 and then captured within the grooves by mounting portion 152 to portion 150. Portion 152 includes matching fastener openings 162 and a lip 164 which mates with a recess 166 in portion 150.

Figures 10, 11, 12:
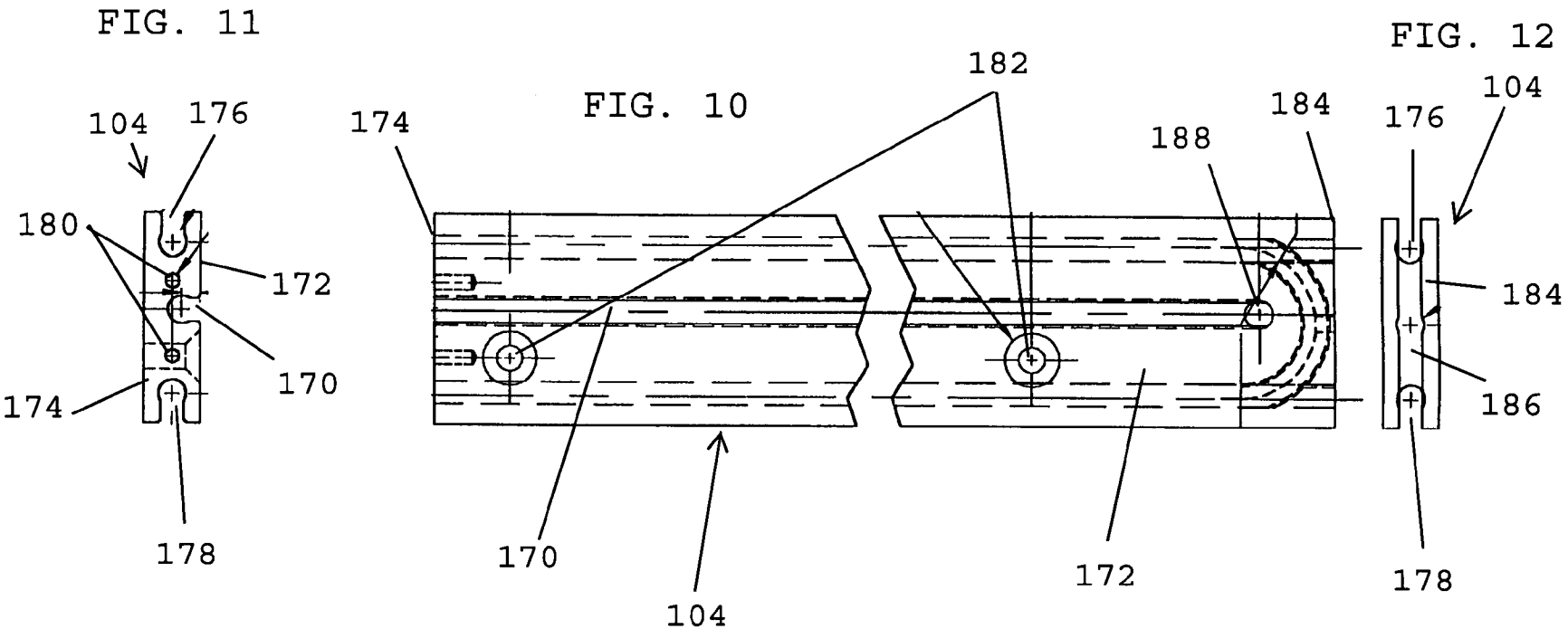
FIG. 10 is a view of an inner wall of a track according to the present disclosure for use with the system of FIG. 1 and the bead guide of FIG. 5.
FIG. 11 is a first end view of the track of FIG. 10.
FIG. 12 is a second end view of the track of FIG. 10.
Figure 16:
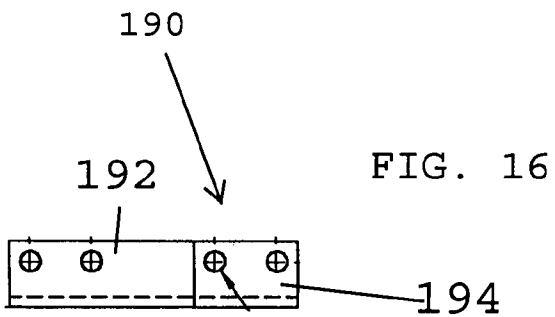
FIG. 16 is a second side view of the slide base of FIG. 13.

Referring now to FIGS. 10 to 12, track 104 is shown with a groove 170 extending along an inner face 172. At a first end 174 of track 104, groove 170 is configured with a broader or wider portion sized to receive ball head 140 of connector 136. A narrower portion extends between the wider portion and inner face 172 and is sized to receive shaft 142 of connector 136 but is too small to permit ball head 140 to pass. This configuration of groove 170 provides a path for movement of connectors 134 of blind 120 as the blind is moved between the retracted and extended positions of system 100.

Adjacent a second end 184 of track 104 is a insertion point 188 where the passage between inner face 172 and the wider portion of groove 170 is sized to permit insertion of ball head 140 into groove 170. Insertion point 188 permits blinds to be mounted to system 100 or removed from the system.

Track 104 further includes a plurality of fastener openings 182 to enable the track to be fitted and mounted adjacent window 102 as part of system 100. Fastener openings 180 are provided in first end 174 to permit mounting of bead guide portions 150 and 152 to the track. Lateral grooves 176 and 178 are provided along front and rear sides of track 104 for passage of the bead chain. Grooves 176 and 178 are connected by a smoothly curved path 186 adjacent second end 184 to permit a continuous length of bead chain to move between grooves 176 and 178. The operation of these grooves 176 and 178, the bead guide and the bead chain are described in the above referenced and incorporated application Ser. No. 11/558,631.

FIGS. 13 to 16 illustrate a slide base 190 for use with system 100 and track 104. Slide base 190 is configured with a pair of legs 192 and 194 sized and configured to extend along the front and rear faces of track 104 and a transverse plate 196 configured to be adjacent inner face 172. Legs 192 and 194 include openings to mount guides configured to be received within grooves 176 and 178. The guide mounted to leg 192 is configured to engage the bead chain within groove 176 and move the slide base when the bead chain is moved. A plurality of fastener openings 198 may be provided in plate 196 to permit mounting of arms for engaging connectors 132 of blind 120 (discussed below).

FIGS. 17 to 28 illustrate elements of system 100 which are configured for mounting along second side 106. The function, configuration and operation of these elements is essentially the same as described above with regard to FIGS. 5 to 16 and have been generally marked with corresponding numbers beginning with 200 instead of 100, if they have not already been defined in FIG. 1. Where the discussion below regarding additional elements of system 100 refers to elements numbered in the 100's, it is intended that these discussions apply equally to parts numbered in the 200's.

Figure 30:
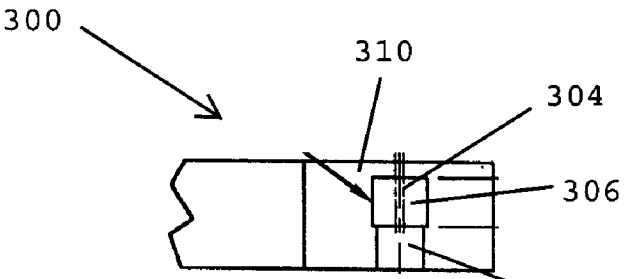
FIG. 30 is a top view of a portion of the fabric arm of FIG. 29.
Figure 31:
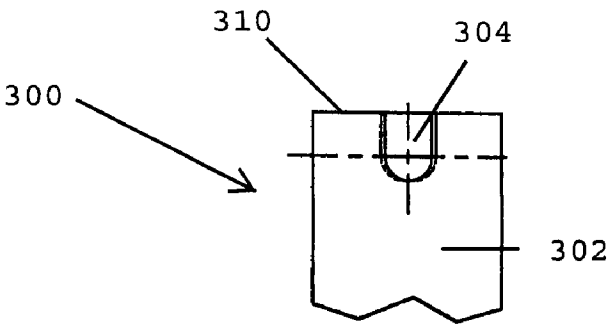
FIG. 31 is a side view of a portion of the fabric arm of FIG. 29.
Figure 29:
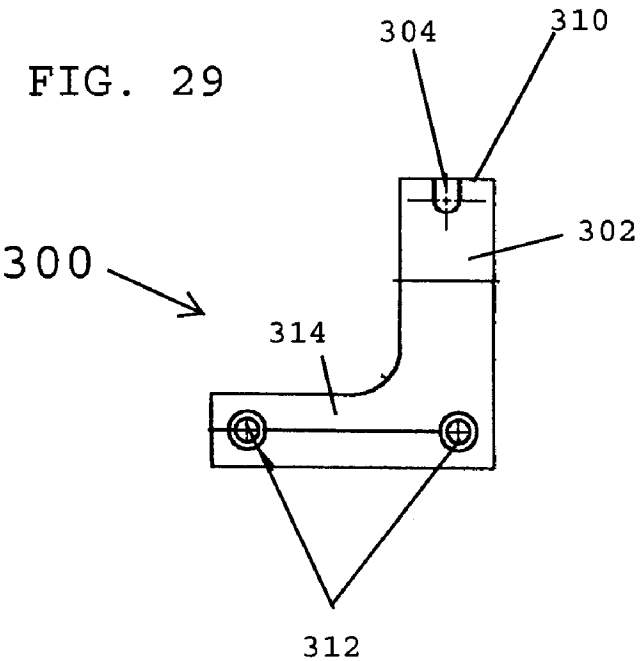
FIG. 29 is a side view of a fabric arm according to the present disclosure for use with the system of FIG. 1 and for mounting to the slide base of FIG. 13.

FIGS. 29 to 31 illustrate a first fabric arm 300 for use with system 100 and mounting to slide base 190. A pair of fastener openings 312 are provided in a transverse bar 314 to permit secure fastening of slide arm 300 to slide base openings 198. An extension 302 includes a top face 310 with a notch 304 for receiving ball head 140 and shaft 142 of connector 132 of blind 120. As illustrated in FIG. 30, notch 304 includes a wider portion 306 sized to receive ball head 140 and a narrower portion 308 sized to receive shaft 142. Portion 308 is sized to not permit passage of ball head 140 so that connector 132 may only be removed or inserted into notch 304 through top face 310.

Notch 304 may also be configured with a narrower opening in top face 310 so that ball head 140 is a snap fit into notch 304. This snap fit will provide a degree of security to ensure that connector 132 does not lose contact with fabric 300 during operation of system 100.

FIGS. 32 to 34 illustrate a second fabric arm 320 for mounting to slide base 190. Arm 320 includes similar fastener openings 322 and a notch 324 in a top face 326 to permit secure mounting to slide base 190 and engagement of ball head 140 of connector 132, respectively. Arm 320 provides a notch that is more centrally located along the slide base and would permit a narrower blind to be used with a wider track 104 in a system 100. Also, it may be desirable to have the blind within system 100 to be offset from the window or the interior edge of the system. Arm 320 permit blind 120 to be positioned as needed with the top rail mounted away from the window or interior edge. Arm 320 further does not position notch 324 on an extension away from slide base 190 but rather mounts connector 132 adjacent the edge of the slide base.

Figure 36:
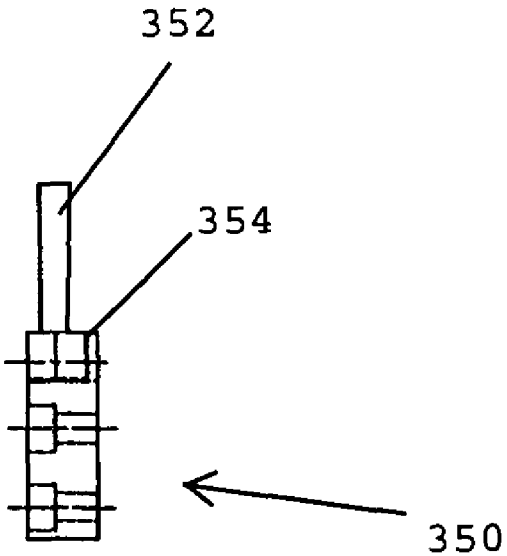
FIG. 36 is a side view of the fabric arm of FIG. 35.
Figure 37:
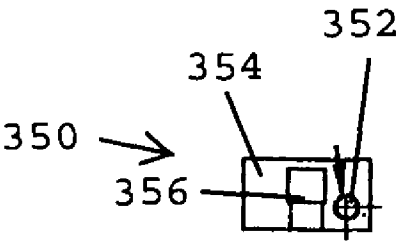
FIG. 37 is a top view of the fabric arm of FIG. 35.
Figure 35:
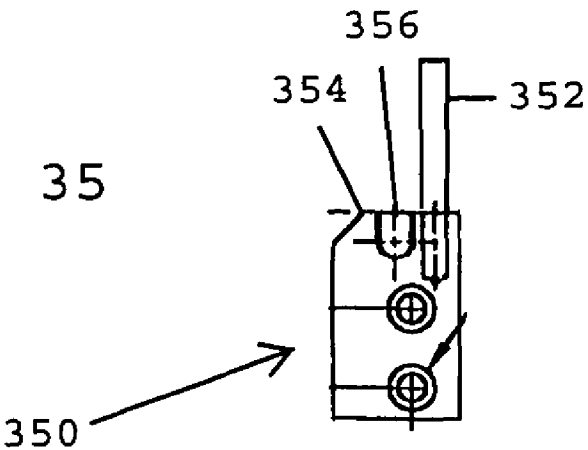
FIG. 35 is a front view of a third embodiment of a fabric arm according to the present disclosure for use with the system of FIG. 1 and for mounting to the slide base of FIG. 13.
Figure 40:
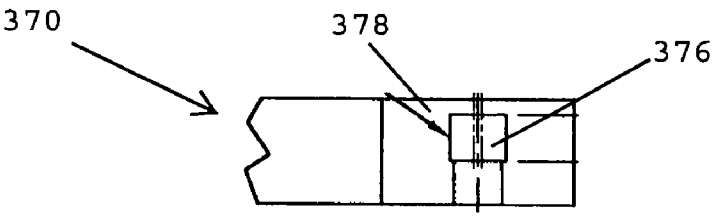
FIG. 40 is a top view of a portion of the fabric arm of FIG. 38.
Figure 39:
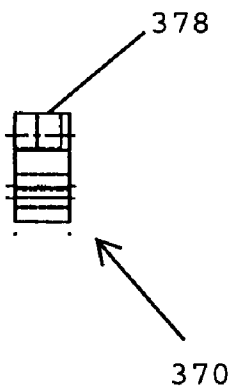
FIG. 39 side view of the fabric arm of FIG. 38.
Figure 38:
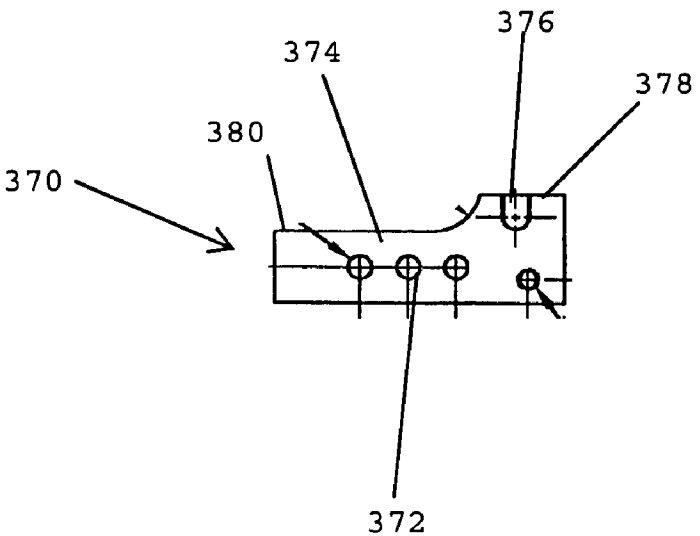
FIG. 38 is a front view of a fourth embodiment of a fabric arm according to the present disclosure for use with the system of FIG. 1 and for mounting to the slide base of FIG. 25.

FIGS. 35 to 37 illustrate a third embodiment of a fabric arm 350 which is configured to cooperate with a fourth embodiment of a fabric arm 370 illustrated in FIGS. 38 to 40. Arms 350 and 370 are configured to more tightly overlap and close off any gaps that might occur between blinds 106 and 110 when the blinds are fully extended. When magnets along a top rail of the blinds are not sufficient to seal the gap or for blinds which do not incorporate a magnet in the top rail, arms 350 and 370 provide for an enhanced gap seal.

Since slide bases 190 and 290 are configured to extend along tracks 104 and 106, respectively, and the tracks have send ends that are adjacent one another at a top of window 102 in system 100, the slide bases cannot overlap each other and at best can be brought into a butting engagement. Arm 350 includes a pin 352 that extends from a top face 354 which also includes a notch 356 for engaging connector 132. Arm 350 would be securely mounted to slide base 190 adjacent leg 194, positioned toward the window. Arm 370 includes a central pivot opening 372 in a transverse bar 374 that is configured to permit arm 370 to be pivotably mounted to plate 296 of slide base 290. A notch 376 is formed in a top face 378 to receive ands engage a connector 132.

Figure 41:
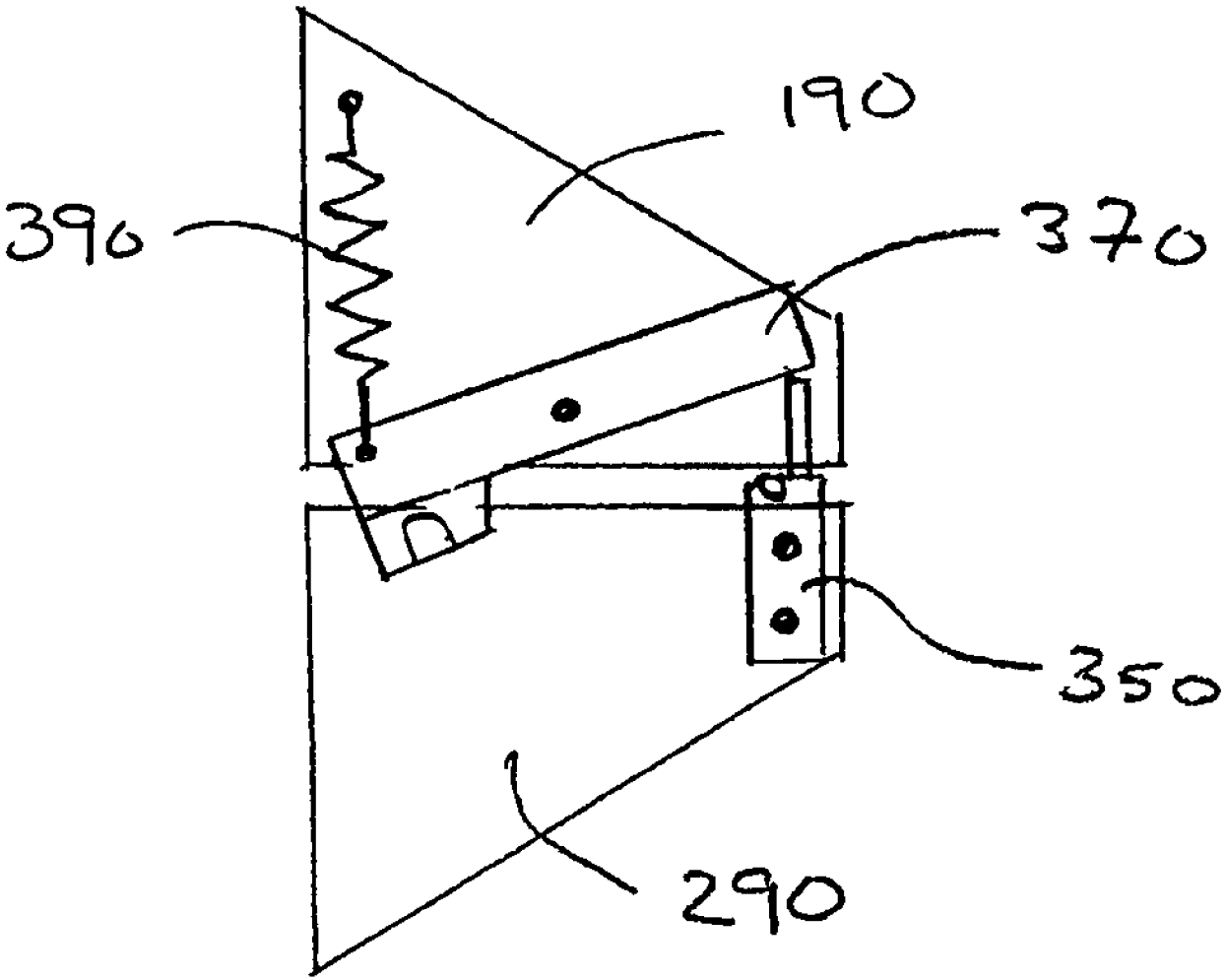
FIG. 41 is a schematic view of the fabric arms of FIGS. 35 and 38 mounting to slide bases and engaging each other according to the present disclosure.

Pin 352 is sized to extend across any gap between the slide bases when the slide bases approach one another as both blinds are in the fully extended position to engage arm 370 at an engagement point 380 on an opposite side of bar 374 from notch 376. As the slide bases 190 and 290 come nearer after pin 352 engages point 380, pin 352 causes arm 370 to rotate about pivot about a fastener in opening 372. This rotation caused by pin 352 extends top face 378 and notch 376 to extend closer toward slide base 190. This extension of notch 376 and the blind 110 engaged by the notch brings the top rails of blinds 106 and 110 into closer engagement to provide a better closure of any gap that might exist when the blinds are fully extended. This engaged and pivoted arrangement of arms 350 and 370 is illustrated in FIG. 41.

When the blinds are retracted, pin 352 moves out of engagement with arm 370 and the arm returns to its neutral position. A spring or other similar resilient member 390 (shown in FIG. 41) may be provided between arm 370 and slide base 290 to urge the arm back to its neutral position. It is desirable to have the arm return to the neutral position as this permits the blind to lay flatter along the bottom of system 100 when fully retracted and does not undesirably block any portion of light or visibility through the window.

Figure 13:
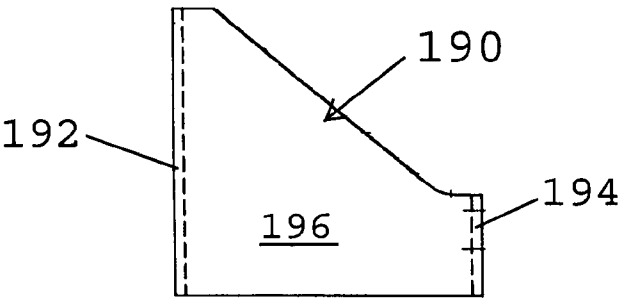
FIG. 13 is a top view of a slide base according to the present disclosure for use with the system of FIG. 1 and the track of FIG. 10.
Figure 18:
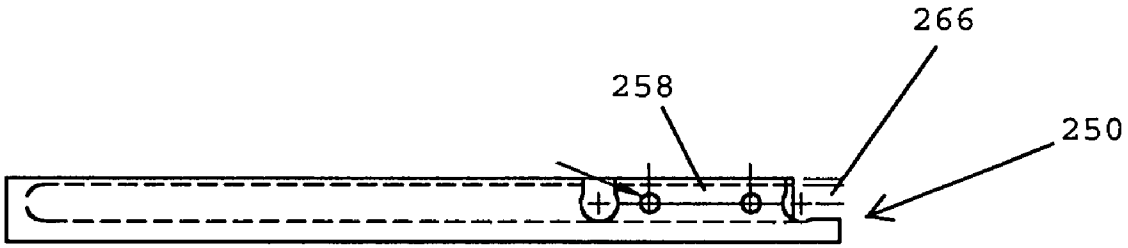
FIG. 18 is a top view of the bead guide portion of FIG. 17.
Figure 17:
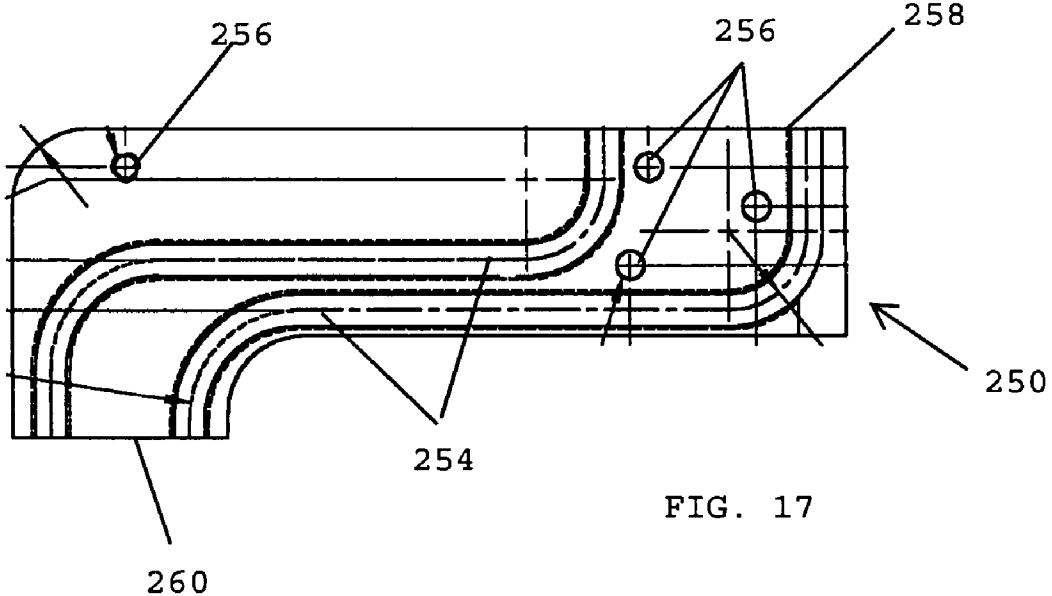
FIG. 17 is an inner wall view of a portion of a bead chain guide according to the present disclosure for use on a second side of the system of FIG. 1.
Figure 19:
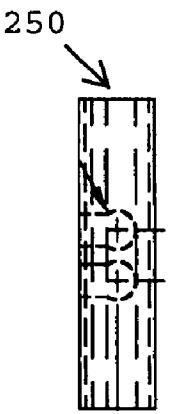
FIG. 19 is an end view of the bead chain guide portion of FIG. 17.
Figure 21:
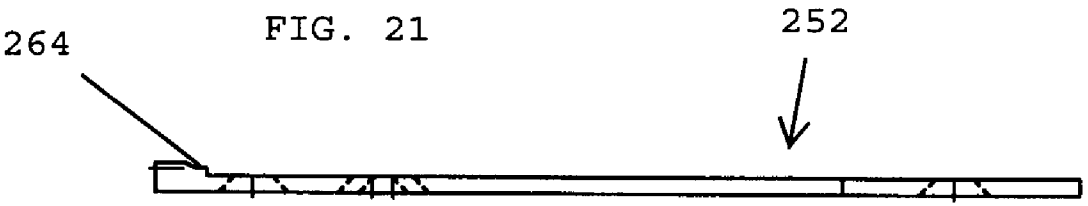
FIG. 21 is a top view of the bead guide portion of FIG. 20.
Figure 20:
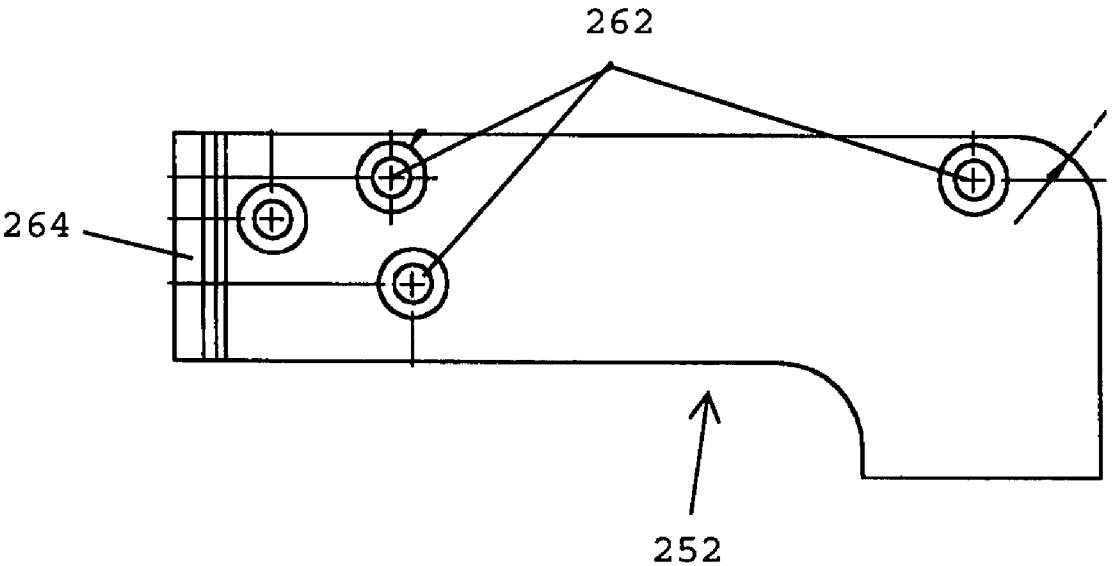
FIG. 20 is an inner wall view of a second mating portion of a bead chain guide according to the present disclosure for use with the system of FIG. 1, in conjunction with the bead guide portion of FIG. 17.
Figure 26:
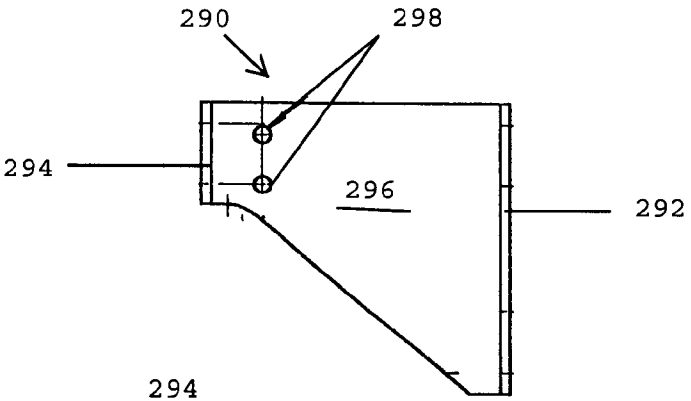
FIG. 26 is a bottom view of the slide base of FIG. 25.
Figure 27:
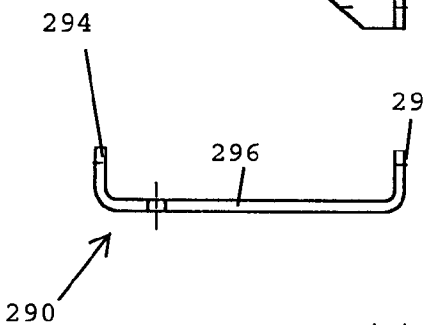
FIG. 27 is a first side view of the slide base of FIG. 25.
Figure 28:
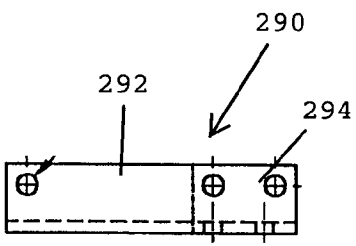
FIG. 28 is a second side view of the slide base of FIG. 25.
Figure 25:
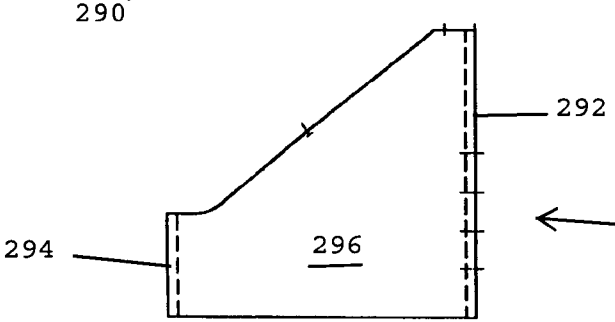
FIG. 25 is a top view of a slide base according to the present disclosure for use with the system of FIG. 1 and the track of FIG. 22.
Figure 42:
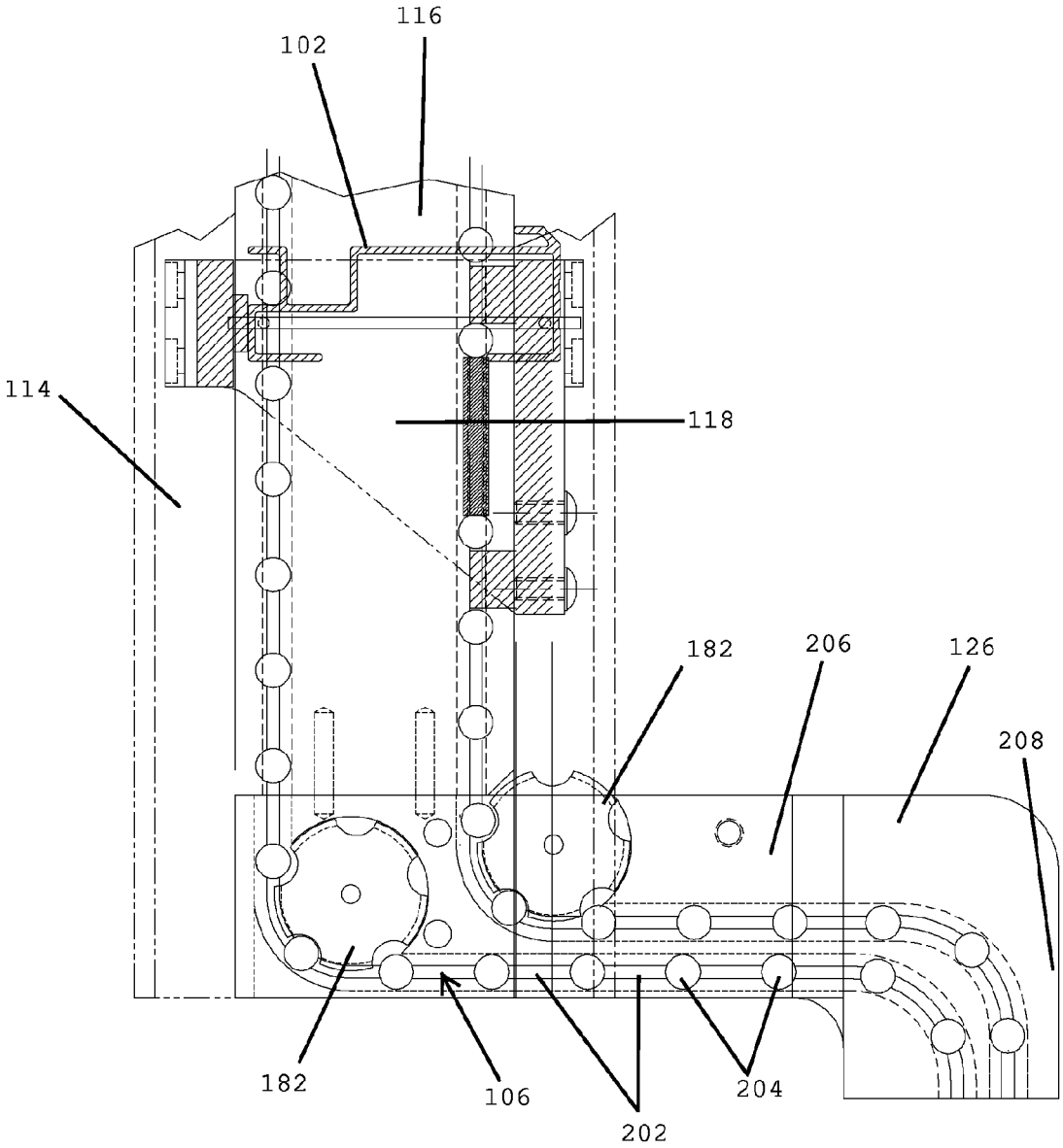
FIG. 42 is a partial cross-sectional side view of an actuating end of the window shade of FIG. 1 of U.S. patent application Ser. No. 11/558,631.
Figure 43:
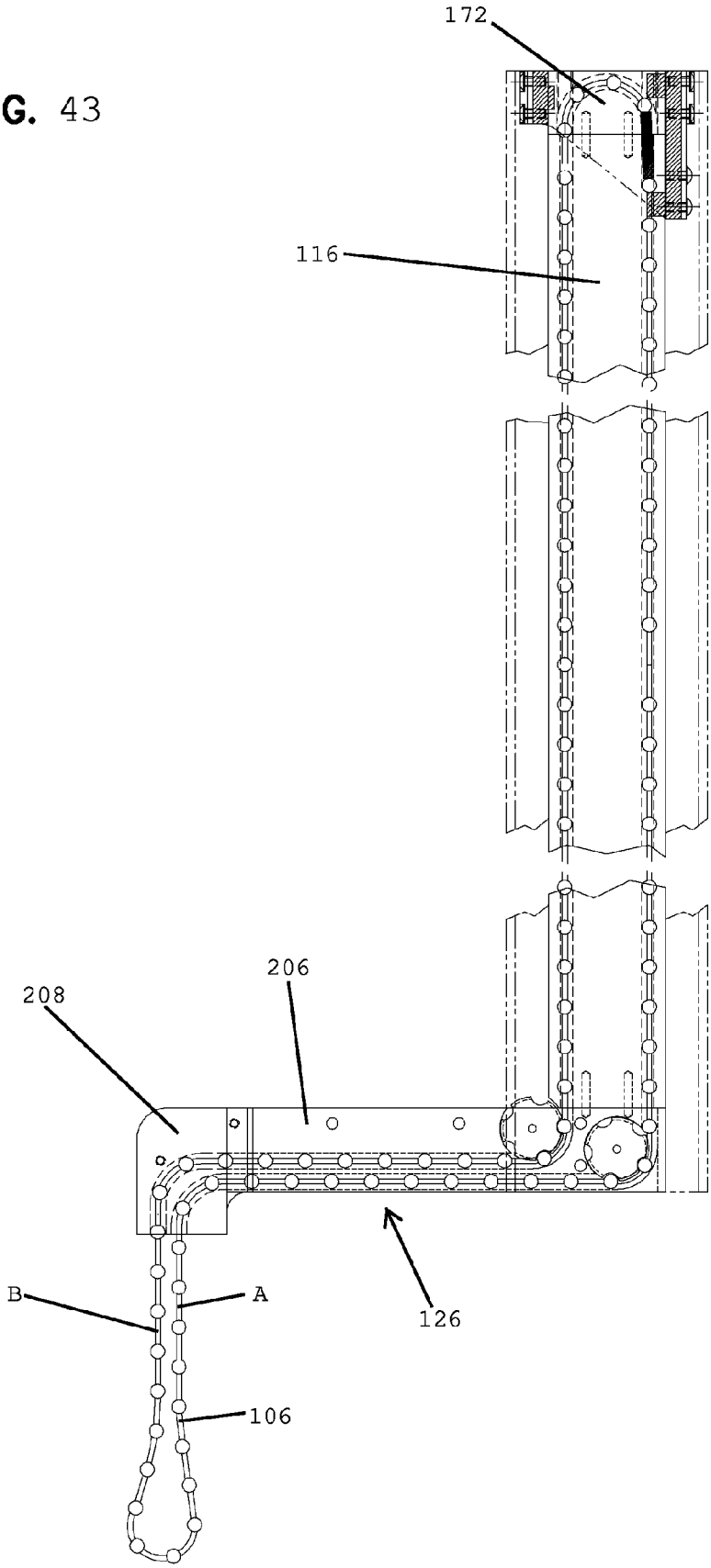
FIG. 43 is a partial cross-sectional view of a an actuating end of a window shade according to the disclosure of U.S. patent application Ser. No. 11/558,631, with a slide attached to a shade element in an intermediate position.

The following description is drawn from U.S. patent application Ser. No. 11/558,631, the disclosure of which was incorporated herein by reference. The references to FIGS. 13 and 14 in the referenced application have been changed to FIGS. 42 and 43 to avoid confusion with the drawings numbered 13 and 14 in the present application. Reference numbers used in the following description and shown in FIGS. 42 and 43 are intended to be limited to these two drawings. As shown in the FIGS. above, actuating shade 100 to move a blind 102 is carried out by use of a bead chain 106. It is anticipated that other types of cords or chains may be used within the scope of the present disclosure. However, it has been determined through experimentation that use of a bead chain such as chain 106 permits larger blinds to be actuated with less force than the other options known at the present time. Bead chain 106 is comprised of a main cord 202 with a plurality of spaced apart beads 204 having a greater diameter than cord 202, as shown in FIG. 13. The beads may be made of plastic or similar materials that have reduced friction within a track 116 as compared to the other options for an actuating cord. For smaller windows, this advantage may not be as desirable, as the forces required to move blinds 102 would not be as great. For larger blinds, used in arched windows having a radius of up to, for example, four or more feet, such reduced friction in the cord may permit greater windows to be shaded. Practical limitations on size may be mainly based on the required tension needed to move blind 102 from collapsed to fully extended, when shades 100 or 200 are manually operated. For motor driven shades, such considerations may be lessened, but reduced friction is generally desirable regardless of the drive used.

Also shown in FIG. 13 is a central extension 206 of a chain guide 126. Extension 206 may be lengthened or shortened as need to provide spacing between the vertical to horizontal transition of bead chain 106 about idlers 182 and the horizontal to vertical transition of bead chain 106 within an outer end 208 of chain guide 126. The length of extension 206 needed may be based on a width of window ledge 104, adjacent trim or other architectural features, or other aesthetic or functional limitations. With incorporation of a power drive to actuate shade 100, the extension 206 and outer end 208 may be eliminated from shade 100 or 200 within the scope of the present disclosure, or may be included to provide a manual backup to the power actuation.

Figure 14:
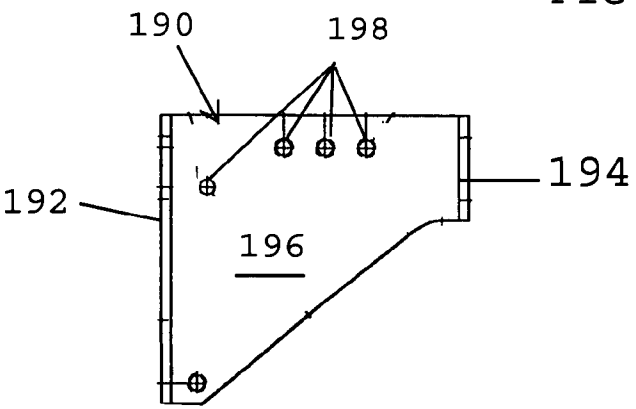
FIG. 14 is a bottom view of the slide base of FIG. 13.
Figure 15:
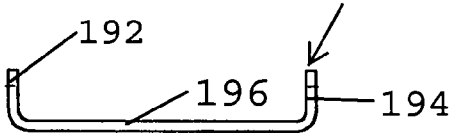
FIG. 15 is a first side view of the slide base of FIG. 13.

FIG. 14 illustrates a longer extension 206 and a wall mounted chain keeper 210. Between chain guide 126 and keeper 210 are two lengths of bead chain 106, labeled A and B. As shown, a slide 118 is slidably mounted to a track 116 by a slide arm 130 and a forked slide arm 132. Forked slide arm 132 engages bead chain 106 within track 116. Tensioning length A by pulling on bead chain 106 will move slide 118 and an attached blind downward. Tensioning length B by pulling on bead chain 106 will move slide 118 and an attached blind upward.

While the apparatus hereinbefore described is effectively adapted to fulfill the aforesaid objects, it is to be understood that the invention is not intended to be limited to the specific preferred embodiments of retractable arched window shade as set forth above. Rather, it is to be taken as including all reasonable equivalents to the subject matter of the appended claims.

What is claimed is:

1. A retractable window covering for covering an arched window, the window covering comprising:

an arched track having a front groove, a rear groove, an inner wall with a face groove, a first end and a second end;

a slide base slidably mounted to the track with first and second legs engaging the front and rear grooves, the slide base movable along the track between the first end and the second end;

a pleated blind having an upper rail and a shade extending therefrom, the upper rail having an outer end of the upper rail attached to the slide base, the upper rail including a stiffener incorporated adjacent an end opposite a pleat;

the upper rail of the blind further including a connector mounted to a front edge of the blind adjacent the upper rail, the connector including an outer ball head configured to engage an arm mounted to the slide base and to move with the slide base;

the front edge of the blind further including at least one connector with a outer ball head configured to engage and be slidably received within the face groove of the track.

2. The retractable window covering of claim 1, wherein the outer ball head of the connector of the upper rail and the outer ball head of the at least one connector of the front edge of the blind are similarly sized and configured.

3. The retractable window covering of claim 1, wherein the connectors of the upper rail and the front edge of the blind include a mounting tab opposite the ball head and a smaller shaft extends between the tab and the ball head.

4. The retractable window covering of claim 1, further comprising the at least one connector of the front edge of the blind includes a mounting tab opposite the ball and a shaft extending between the ball head and the tab, the shaft sized smaller than the ball head, and further comprising the face groove of the track having an inner portion sized to receive and allow movement of the ball head and an outer portion sized to receive the shaft and not permit passage the ball head.

5. The retractable window covering of claim 4, the track further comprising an opening through the outer portion of the face groove to permit insertion of the ball head through the inner face and into the face groove.

6. The retractable window covering of claim 5, wherein the ball head insertion opening of the face groove is positioned adjacent a second end of the track.

7. The retractable window covering of claim 1, wherein the blind is a non-cellular blind.

8. The retractable window covering of claim 1, wherein the blind includes a magnet in the upper rail.

9. The retractable window covering of claim 1, wherein the blind includes a plurality of pleats and the connectors along the front edge are mounted intermediately between pleats.

10. The retractable window covering of claim 9, wherein the blind includes a pocket positioned along one or more of the pleats.

11. The retractable window covering of claim 10, wherein each inward facing pleat includes a pocket extending between the inner end and the outer end.

12. The retractable window covering of claim 10, further comprising a stiffener inserted within at least one of the pockets.

13. The retractable window covering of claim 1, further comprising the arm connected to the slide base being pivotably mounted, the system further comprising a member positioned to engage the arm when the blind is fully extended to defect the arm and extend the position of the outer end of the upper rail further away from the slide base.

14. The retractable window covering of claim 1, wherein the arm is urged to return to a non-deflected position when the blind is positioned at less than full extension.

15. The retractable blind of claim 1, further comprising a second similarly configured blind, track and other elements, the system configured to cover an arched window extending approximately one hundred and eighty degrees.

* * * * *